US008672039B2

(12) United States Patent
Miller, III et al.

(10) Patent No.: US 8,672,039 B2
(45) Date of Patent: Mar. 18, 2014

(54) COILED TUBING INLINE MOTION ELIMINATOR APPARATUS AND METHOD

(75) Inventors: Joseph Hayden Miller, III, Katy, TX (US); Joseph Hayden Miller, Jr., Lafayette, LA (US)

(73) Assignee: Devin International, Inc., Lafayette, LA (US)

( * ) Notice: Subject to any disclaimer, the term of this patent is extended or adjusted under 35 U.S.C. 154(b) by 62 days.

(21) Appl. No.: 13/031,772

(22) Filed: Feb. 22, 2011

(65) Prior Publication Data

US 2011/0308808 A1 Dec. 22, 2011

Related U.S. Application Data

(60) Provisional application No. 61/307,693, filed on Feb. 24, 2010.

(51) Int. Cl.
*E21B 7/12* (2006.01)

(52) U.S. Cl.
USPC ..... 166/350; 166/355; 166/367

(58) Field of Classification Search
USPC ..... 166/350–355, 367; 114/268, 269, 201, 114/382
See application file for complete search history.

(56) References Cited

U.S. PATENT DOCUMENTS

| | | | | |
|---|---|---|---|---|
| 2,187,392 | A | 1/1940 | Chappell | |
| 2,685,378 | A * | 8/1954 | Stone | 414/800 |
| 3,302,709 | A * | 2/1967 | Postlewaite | 166/340 |
| 3,308,881 | A * | 3/1967 | Chan et al. | 166/340 |
| 3,658,298 | A | 4/1972 | Moore et al. | |
| 3,681,928 | A * | 8/1972 | Vincken et al. | 405/196 |
| 4,147,221 | A | 4/1979 | Ilfrey et al. | |
| 4,200,054 | A * | 4/1980 | Elliston | 114/264 |
| 4,423,994 | A * | 1/1984 | Schefers et al. | 414/22.68 |
| 4,836,300 | A * | 6/1989 | Reed | 175/57 |
| 6,343,893 | B1 * | 2/2002 | Gleditsch | 405/196 |
| 6,443,240 | B1 * | 9/2002 | Scott | 175/7 |
| 6,901,998 | B1 * | 6/2005 | Roodenburg et al. | 166/85.1 |
| 6,926,103 | B1 * | 8/2005 | Roodenburg et al. | 175/203 |
| 6,929,071 | B2 | 8/2005 | Moncus | |
| 6,932,553 | B1 * | 8/2005 | Roodenburg et al. | 414/22.51 |
| 6,988,459 | B2 * | 1/2006 | Roodenburg et al. | 114/268 |
| 7,083,004 | B2 * | 8/2006 | Roodenburg et al. | 175/5 |
| 7,191,837 | B2 * | 3/2007 | Coles | 166/355 |
| 7,404,443 | B2 * | 7/2008 | Patton et al. | 166/355 |
| 2006/0011350 | A1 | 1/2006 | Wiggins et al. | |
| 2007/0089882 | A1 | 4/2007 | Patton et al. | |
| 2008/0099208 | A1 | 5/2008 | Moncus et al. | |

OTHER PUBLICATIONS

Int'l Search Report, May 6, 2011, PCT/US11/025699.
Written Opinion, May 6, 2011, PCT/US11/025699.

* cited by examiner

*Primary Examiner* — Matthew Buck
*Assistant Examiner* — Aaron Lembo
(74) *Attorney, Agent, or Firm* — Jones Walker LLP

(57) ABSTRACT

An apparatus for performing well intervention work using coiled tubing. The apparatus includes a structural frame. The upper portion of the frame include two winches for suspending well interventions tools including a coiled tubing injector head. The winches may be selective reciprocated by a hydraulic cylinder to either bring the first or second winch into operative alignment into or out of alignment with a subsea wellhead.

20 Claims, 5 Drawing Sheets

COILED TUBING INLINE MOTION ELIMINATOR APPARATUS AND METHOD

CROSS-REFERENCE TO RELATED APPLICATIONS

This application claims the benefit of and priority to U.S. provisional application No. 61/307,693, filed Feb. 24, 2010, which is incorporated herein by reference.

BACKGROUND OF THE INVENTION

The present invention relates to a coiled tubing inline motion eliminator apparatus and method.

SUMMARY OF THE INVENTION

The present invention is drawn to a unique apparatus for deploying coiled tubing on an offshore or other platform that may not have a derrick or other support structure available for running a tool downhole. Such platforms may include, for example, an offshore production platform. The apparatus comprises a frame assembly including a base frame, a lower frame member and an upper frame member detachably secured together. A monorail is positioned on the upper frame member. A winch assembly is operatively connected to the monorail. The winch assembly comprises a first winch and a second winch. Each of the first and second winches includes a hoisting means. A hydraulic cylinder is operatively associated with the winch assembly. Actuation of the hydraulic cylinder causes reciprocation of the winch assembly to move either the first or second winch into or out of operative alignment with a wellhead.

The first winch may have a lighter load capability than the second winch.

The apparatus may further comprise a motion compensator. The motion compensator is suspended by the hoisting means of the second winch.

The apparatus may further comprise a coiled tubing injector head. The injector head is detachably affixed to the motion compensator.

The coiled tubing injector head may be in operative alignment with the wellhead.

The apparatus may further comprise a hydraulic pin positioned on the upper frame member. The hydraulic pin is selectively actuated to engage a pin retaining receptacle of the motion compensator.

The apparatus may further comprise a well intervention tool suspended by the hoisting means of the first winch. The tool is out of operative alignment with the wellhead.

The frame assembly may be modular and include a plurality of stackable frame units.

In another embodiment, the apparatus includes a frame assembly having a base frame, a lower frame member and an upper frame member detachably secured together. A reciprocating plate is positioned on the upper frame member. A winch assembly is operatively connected to the reciprocating plate. The winch assembly comprises a first winch and a second winch. Each of the first and second winches includes a hoisting means. The hoisting means are each capable of being extending through an aperture in the reciprocating plate. A hydraulic cylinder is operatively associated with the reciprocating plate. Actuation of the hydraulic cylinder causes reciprocation of the reciprocating plate to move either the first or second winch into or out of operative alignment with a wellhead.

In the alternative apparatus, the first winch has a lighter load capability than the second winch.

The alternative apparatus may further comprise a motion compensator. The motion compensator is suspended by the hoisting means of the second winch.

The alternative apparatus may further comprise a coiled tubing injector head. The injector head is detachably affixed to the motion compensator.

In the alternative apparatus, the coiled tubing injector head is in operative alignment with the wellhead.

The alternative apparatus may further comprise a hydraulic pin positioned on the upper frame member. The hydraulic pin is selectively actuated to engage a pin retaining receptacle of the motion compensator.

The alternative apparatus may further comprise a well intervention tool suspended by the hoisting means of the first winch. The tool is out of operative alignment with the wellhead.

In the alternative apparatus, the frame assembly is modular and includes a plurality of stackable frame units.

The present invention is also drawn to a method of conducting well intervention work using coiled tubing. The method comprising the steps of assembling the apparatus of the present invention or the alternative apparatus described herein above. The method includes the step of suspending a motion compensator from the hoisting means of the second winch. The method includes the step of detachably connecting a coiled tubing injector head to the motion compensator. The method includes the step of actuating the hydraulic cylinder to reciprocate the winch assembly or reciprocating plate to bring the second winch into operative alignment with a subsea wellhead. The method includes the step of operatively connecting the coiled tubing injector head to the subsea wellhead. The method includes the step of running coiled tubing into the coiled tubing injector head and down through the subsea well head and into a section of a well where well intervention work is desired to be performed. The method includes the step of performing the well intervention work.

In the method, the apparatus may further comprises a hydraulic pin positioned on the upper frame member. The hydraulic pin is selectively actuated to engage a pin retaining receptacle of the motion compensator. The method may further comprise the step of actuating the hydraulic pin to engage the pin retaining receptacle of the motion compensator.

The method may further comprise the step of suspending a well intervention tool to the hoisting means of the first winch. The method may further include the steps of removing the coiled tubing from the well and the coiled tubing injector head. The method may further include the steps of reciprocating the winch assembly or reciprocating plate to move the second winch out of operative alignment with the subsea wellhead and the first winch into alignment with the subsea wellhead. The method may further include the step of operatively connecting the well intervention tool to the well. The method may further include the step of performing additional well intervention work on the well using the well intervention tool.

The method may further comprise the step of disconnecting the well intervention tool from the well. The method may further comprise the step of removing the well intervention tool from the hoisting means of the first winch. The method may further include the steps of removing the motion compensator and coiled tubing injector head from the hoisting means of the second winch. The method may further include the step of disassembling the apparatus.

An advantage of the present invention is the elimination of unsafe overhead crane operations.

Another advantage of the present invention is the ability to conduct coiled tubing operations on platforms without a derrick or other supporting structure.

Yet another advantage of the present invention is the ease and efficiency of assembling a frame structure that supports a coiled tubing injector head over the wellhead to carryout coiled tubing operations.

Yet another advantage of the present invention is the ability to quickly and easily move the coiled tubing injector head out of alignment with the wellhead during temporary cessation of coiled tubing operations.

Yet another advantage of the present invention is the ability to suspend two tools at one time and to selectively move the tools into and out of alignment with the wellhead to perform well intervention tasks.

Yet another advantage of the present invention is the ability to compensate for the vertical movement of the platform.

DETAILED DESCRIPTION OF THE INVENTION

Figure 1:
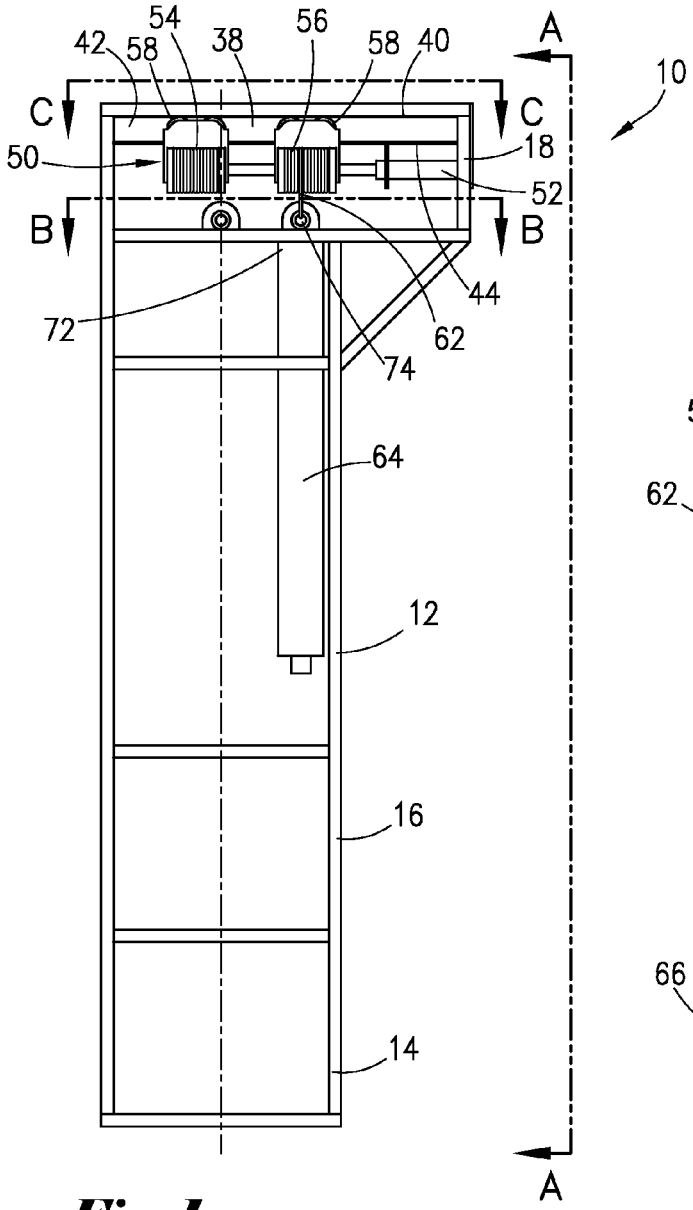
FIG. 1 is a side view of one embodiment of the present invention.

As shown in FIGS. 1-4, coiled tubing inline motion eliminator apparatus 10 includes frame assembly 12, which may be positioned over a wellhead (not shown). Frame assembly 12 includes base frame 14 for supporting lower frame member 16 and upper frame member 18. Frame assembly 12 may be a modular frame. For example, frame assembly 12 may be formed of a plurality of sub-frame units that may be detachably affixed together to form frame assembly 12. Frame assembly 12 may be made of any material suitable for structural support. For example, frame assembly 12 may be made of metal such as steel. Fixation of sub-frame units may be undertaken by any means capable of suitable connection such as pins, bolts or the like. Frame assembly 12 may be any shape such as rectangular-shaped or square-shaped. Frame assembly 12 may have a height of about 55.5 feet. Base frame 14 and lower frame member 16 may have a width of about 13.0 feet. Each sub-frame unit forming base frame 14 and lower frame members 16 may have a height of about 8.0 feet and a width of about 13.0 feet. Upper frame member 18 may have a width of about 20.0 feet and a height of about 7.5 feet.

Again with reference to FIGS. 1-4, upper frame member 18 includes lower support member 20. Lower support member 20 includes a first pair of opposed side supports 22 and a second pair of opposed side supports 24. Lateral supports 26 and 28 extend between first pair of opposed side supports 22. Hydraulic locking pin 30 is affixed to the upper surface of one of side supports 24 and lateral support 26. Hydraulic locking pin 30 may be affixed in a variety of ways that secure pin 30 to lower support member 20. For example, hydraulic locking pin 30 may be attached by screws, bolts, clamps, or other suitable means.

With further reference to FIGS. 1-4, upper frame member 18 includes upper support member 32. Upper support member 32 includes a first pair of opposing side supports 34 and a second pair of opposing side supports 36. Monorail 38 extends laterally between opposing side supports 34. Monorail 38 includes upper rail support 40, four interconnecting side rail supports 42, and lower rail support 44. Monorail 38 may be affixed to side supports 34 by a variety of means. For example, ends 48 of monorail 38 may be connected to side supports 34 or ends 48 at upper rail support 40 of monorail 38 may be connected to the underside of side supports 34. Such connection may be by welding or other suitable fixation means such as screws, bolts, rivets, or the like. Upper frame member 18 also includes winch assembly 50 and hydraulic cylinder 52. Winch assembly 50 may include first winch 54 and second winch 56. Winch 56 may have a higher weight capacity than winch 54. Winches 54, 56 each have a pair of rollers 58, which are movably positioned on monorail 38. For example, rollers 58 may be contained on or within monorail 38.

Again with reference to FIGS. 1-4, hydraulic cylinder 52 is operatively connected to winch assembly 50. When actuated, hydraulic cylinder 52 either selectively moves winch assembly 50 in a first direction along the axis Z-Z of monorail 38 or in a second opposite direction along the axis Z-Z of monorail 38. Winches 54, 56 each contains a hoisting means 62 such as a wire rope, cord, chain or the like capable of supporting tools and other equipment that may be used for well intervention operations, as for example, a coiled tubing injector head. Winches 54, 56 may be selectively actuated to lower or lift such tools and equipment, and in conjunction with the actuations of hydraulic cylinder 52, to move such tools or equipment along axis Z-Z to either place such tools or equipment in line with the wellhead or out of line with the wellhead depending on whether such tools or equipment will be operatively connected to the wellhead and/or well for well intervention operations.

Figure 2:
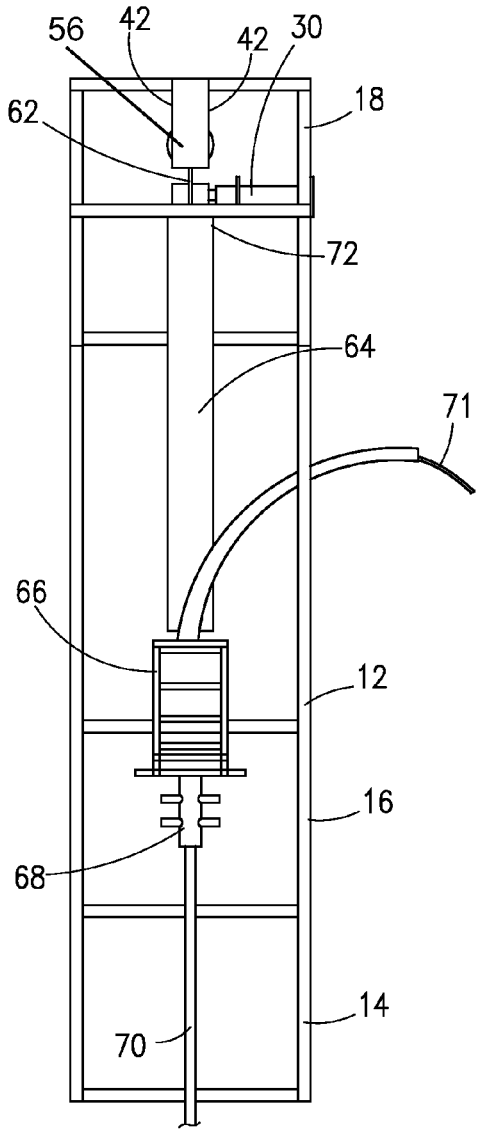
FIG. 2 is a cross-sectional view of the device shown in FIG. 1 taken along plane A-A.
Figure 3:
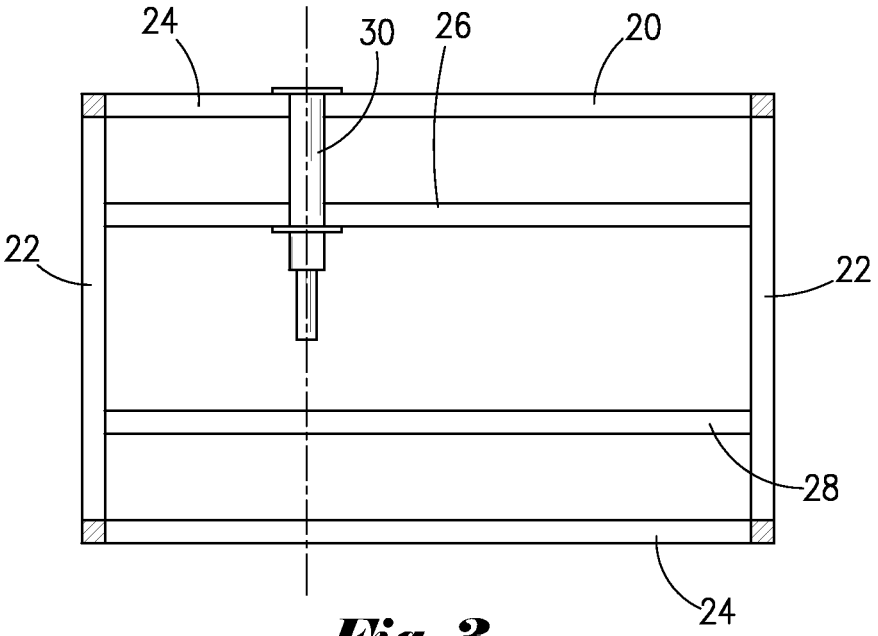
FIG. 3 is a cross-sectional top view of the device shown in FIG. 1 taken along plane B-B.
Figure 4:
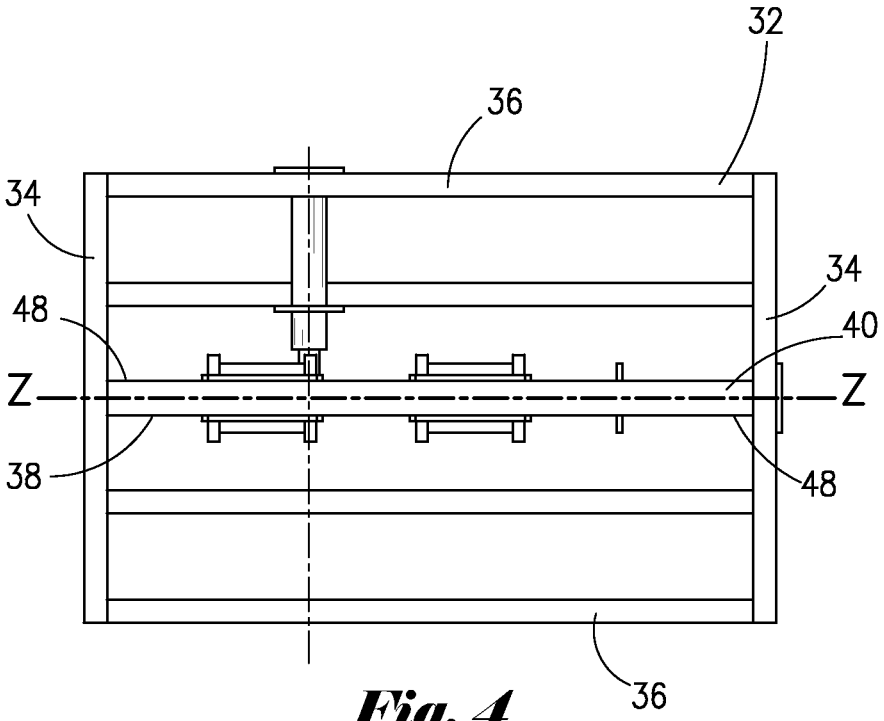
FIG. 4 is a cross-sectional top view of the device shown in FIG. 1 taken along plane C-C.
Figure 5:
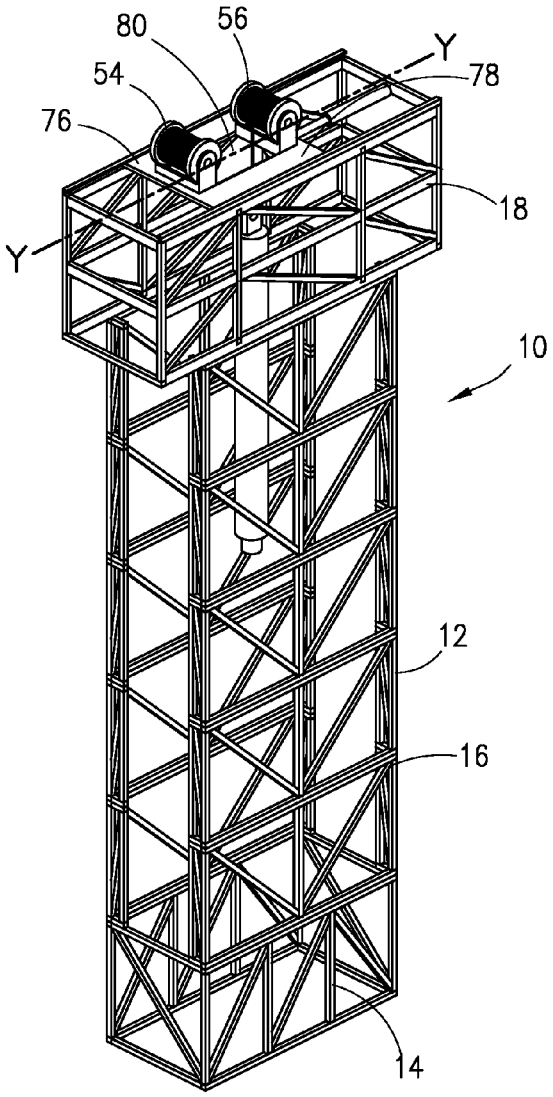
FIG. 5 is an isometric view of another embodiment of the present invention.
Figure 6:
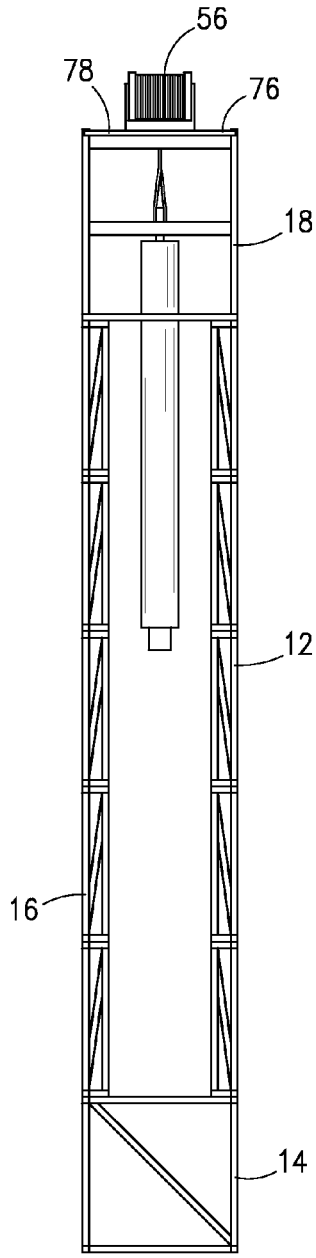
FIG. 6 is a side view of the device shown in FIG. 5.
Figure 7:
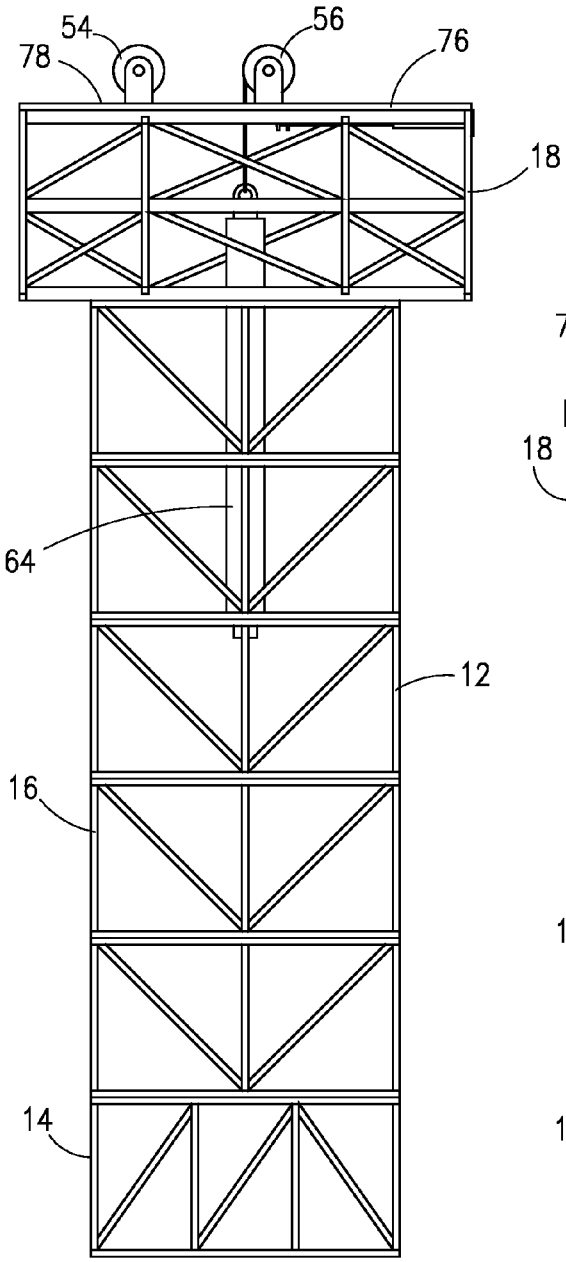
FIG. 7 is a front view of the device shown in FIG. 5.
Figure 8:
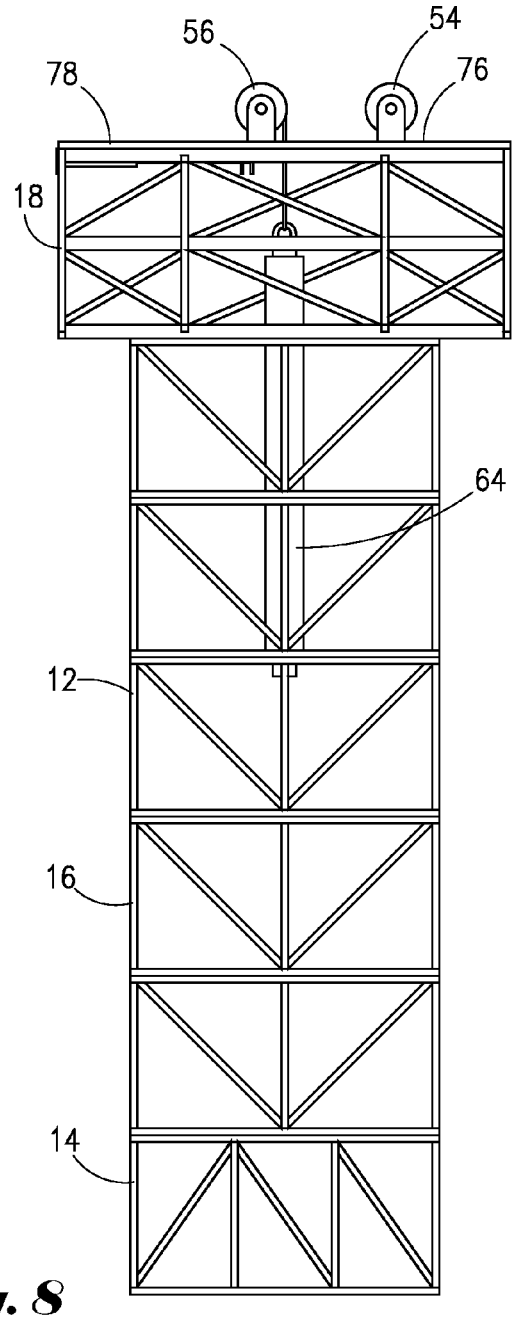
FIG. 8 is a back view of the device shown in FIG. 5.

FIGS. 1 and 2 shows winch 56 supporting motion compensator 64. Motion compensator 64 may be of the type disclosed in U.S. Pat. No. 6,929,071, which is incorporated herein by reference.

FIG. 2 shows winch 56 further supporting coiled tubing injector head 66. Blowout preventer ("BOP") 68 is operatively connected to injector 66. Tubular 70 is operatively connected to blowout preventer 68. Tubular 70 is operatively connected to the wellhead and/or well (not shown). Coiled tubing 71 is run through injector head 66 and into and through blowout preventer 68 and tubular 70 to a location downhole where well intervention work is to be or is being performed. In this operational position, hydraulic pin 30 is actuated to engage compensator 64. For example, upper end 72 of compensator 64 may contain pin receptacle 74 for receiving pin 30. When engaged pin 30 is engaged in receptacle 74, compensator 64 is retained in position along axis 60. Such retention keeps the tools, such as injector head 66, in alignment with the wellhead. The retention of upper end 72 of compensator 64 also enables the reciprocation of compensator 64 to compensate for vertical movement of apparatus 10 when operatively positioned on a floating platform due to wave action or changes in the sea level.

Apparatus 10 may include a second tool hoisted by winch 54. The second tool may be a tool that will be necessary to operatively connect to the wellhead and/or well once coiled tubing, operations are completed or partially completed. For example, if coiled tubing operations are completed or partially completed and the second tool must be used to conduct further well intervention, injector head 66 (or injector head 66 and BOP 68) is disconnected. Hydraulic pin 30 is removed from receptacle 74. Actuation of hydraulic cylinder 52 causes winch assembly 50 to more along axis Z-Z so that winch 56 is out of alignment with the wellhead and the winch 54 and the second tool is brought into alignment with the wellhead. The second tool is connected to the wellhead. Hydraulic pin 30 may or may not be activated to retain the second tool. Well intervention work is then carried out using the second tool. The second tool may be any tool used for well intervention purposes. For example, the second tool may be a tool to conduct work-over, snubbing, completion, and/or plug and abandonment.

FIGS. 5-8 illustrate another embodiment of apparatus 10. In this embodiment, winches 54, 56 are positioned on upper surface 76 of reciprocating plate 78 of upper frame member 18. Plate 76 contains opening or aperture 80 through which hoisting means 62 may extend to hoist or support a tool or other well intervention equipment such as injector head 66 or a second tool. Hydraulic cylinder 52 is operatively associated with plate 76. When hydraulic cylinder is actuated, plate 76 containing winches 54, 56 moves forward or backwards along axis Y-Y.

Figure 9:
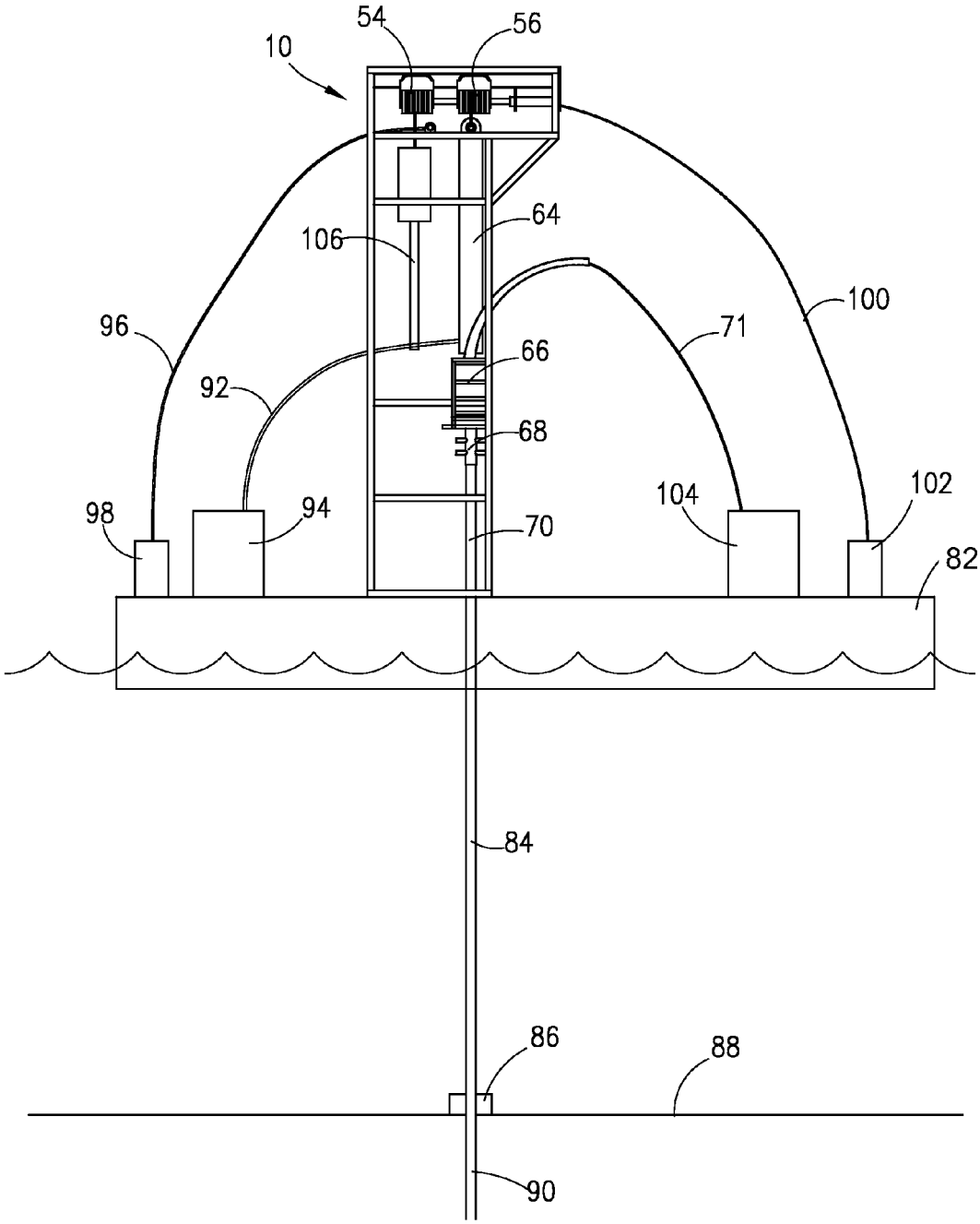
FIG. 9 is a perspective view of an embodiment of the present invention deployed on an offshore platform.

FIG. 9 shows apparatus 10 assembled and in position on floating platform 82. Winch 56 is supporting compensator 64, injector head 66, BOP 68 and tubular 70. Tubular 70 is fluidly connected to work string 84 that extends to wellhead 86 that is on seabed 88. Coiled tubing 71 is positioned through injector head 66, down through to the work string 84 and into well 90 where well intervention operations are being carried out. Inlet and outlines 92 interconnect compensator 64 to power pack means 94 that supplies a power source necessary to operate compensator 66. The power source may be pneumatic power such a nitrogen gas. Alternatively, the power source could be hydraulic fluid.

Also as seen in FIG. 9, inlet and outlines 96 interconnect hydraulic pin 30 to power pack means 98 that supplies a power source necessary to operate pin 30. The power source may be hydraulic fluid. Alternatively, pin 30 could be operated by pneumatic means such as a gas source such as air or nitrogen. Inlet and outlet lines 100 interconnect hydraulic cylinder 52 to power pack means 102 that supplies a power source necessary to operate cylinder 52. The power source may be hydraulic fluid. Alternatively, cylinder 52 could be operated by pneumatic means such as a gas source such as air or nitrogen. It is possible to combine power pack means 98 and 102 so that either pack means 98 or 102 operate both hydraulic pin 30 and hydraulic cylinder 52.

With reference to FIG. 9, coiled tubing surface equipment 104 provides the coiled tubing and other required equipment to operate same. The equipment may be a tubing reel, a control house, and a power pack. Winch 54 is shown suspending second tool 106 that may have already been operatively connected to well 90 and moved out of alignment with wellhead 86 by actuation of winch assembly 50 upon completion of the work or is standing-by to be placed into alignment with wellhead 86 and operatively connected to well 90 after removal of coiled tubing 71 from injector 66 and actuation of winch assembly 50 to bring second tool 106 into alignment with wellhead 86.

Base 14 may be used with stowable and adjustable work platforms that may be added thereto. The platforms permit rig personnel to work safely during rig up and also during the deployment of downhole tools.

While preferred embodiments of the present invention have been described, it is to be understood that the embodiments are illustrative only and that the scope of the invention includes the many variations and modifications naturally occurring to those skilled in the art from a review hereof.

What is claimed is:

1. An apparatus comprising:

a) a frame assembly including a base frame, a lower frame member and an upper frame member detachably secured together;

b) a horizontally-extending monorail positioned on the upper frame member;

c) a winch assembly operatively suspended from the monorail, the winch assembly comprising a first winch and a second winch, each of the first and second winches including a hoisting means;

d) a hydraulic cylinder operatively associated with the winch assembly, wherein actuation of the hydraulic cylinder causes horizontal reciprocation of the winch assembly along the monorail to move either the first or second winch horizontally into or out of operative alignment with a wellhead.

2. The apparatus according to claim 1 wherein the first winch has a lighter load capability than the second winch.

3. The apparatus according to claim 2 further comprising: (e) a motion compensator, the motion compensator suspended by the hoisting means of the second winch.

4. The apparatus according to claim 3 further comprising: (f) a coiled tubing injector head, the injector head detachably affixed to the motion compensator.

5. The apparatus according to claim 4 wherein the coiled tubing injector head is in operative alignment with the wellhead.

6. The apparatus according to claim 5 further comprising: (g) a hydraulic pin positioned on the upper frame member, the hydraulic pin being selectively actuated to engage a pin retaining receptacle in an upper end of the motion compensator.

7. The apparatus according to claim 6 further comprising: (h) a well intervention tool suspended by the hoisting means of the first winch, the tool being out of operative alignment with the wellhead.

8. The apparatus of claim 1 wherein the frame assembly is modular and includes a plurality of stackable frame units.

9. An apparatus comprising:

a) a frame assembly including a base frame, a lower frame member and an upper frame member detachably secured together;

b) a reciprocating plate positioned on the upper frame member, the reciprocating plate comprising an aperture;

c) a winch assembly operatively connected to and disposed on an upper surface of the reciprocating plate, the winch assembly comprising a first winch and a second winch, each of the first and second winches including a hoisting means, each hoisting means capable of extending through the aperture in the reciprocating plate;

d) a hydraulic cylinder operatively associated with the reciprocating plate, wherein actuation of the hydraulic cylinder causes reciprocation of the reciprocating plate to move either the first or second winch into or out of operative alignment with a wellhead.

10. The apparatus according to claim 9 wherein the first winch has a lighter load capability than the second winch.

11. The apparatus according to claim 10 further comprising: (e) a motion compensator, the motion compensator suspended by the hoisting means of the second winch.

12. The apparatus according to claim 11 further comprising: (f) a coiled tubing injector head, the injector head detachably affixed to the motion compensator.

13. The apparatus according to claim 12 wherein the coiled tubing injector head is in operative alignment with the wellhead.

14. The apparatus according to claim 13 further comprising: (g) a hydraulic pin positioned on the upper frame member, the hydraulic pin being selectively actuated to engage a pin retaining receptacle in an upper end of the motion compensator.

15. The apparatus according to claim 14 further comprising: (h) a well intervention tool suspended by the hoisting means of the first winch, the tool being out of operative alignment with the wellhead.

16. The apparatus of claim 9 wherein the frame assembly is modular and includes a plurality of stackable frame units.

17. A method of conducting well intervention work using coiled tubing, comprising the steps of:

a) assembling an apparatus comprising: a frame assembly including a base frame, a lower frame member and an upper frame member detachably secured together; a reciprocating plate comprising an aperture or a horizontally-extending monorail positioned on the upper frame member; a winch assembly operatively connected to and disposed on an upper surface of the reciprocating plate or operatively suspended from the monorail, the winch assembly comprising a first winch and a second winch, each of the first and second winches including a hoisting means, each hoisting means capable of extending through the aperture in the reciprocating plate if the winch assembly is operatively connected to the reciprocating plate; a hydraulic cylinder operatively associated with the winch assembly or reciprocating plate, wherein actuation of the hydraulic cylinder causes horizontal reciprocation of the winch assembly or reciprocating plate to move either the first or second winch horizontally into or out of operative alignment with a subsea wellhead;

b) suspending a motion compensator from the hoisting means of the second winch;

c) detachably connecting a coiled tubing injector head to the motion compensator;

d) actuating the hydraulic cylinder to horizontally reciprocate the winch assembly or reciprocating plate to bring the second winch into operative alignment with the subsea wellhead;

e) operatively connecting the coiled tubing injector head to the subsea wellhead;

f) running coiled tubing into the coiled tubing injector head and down through the subsea well head and into a section of a well where well intervention work is desired to be performed;

g) performing the well intervention work.

18. The method according to claim 17 wherein the apparatus further comprises a hydraulic pin positioned on the upper frame member, the hydraulic pin being selectively actuated to engage a pin retaining receptacle in an upper end of the motion compensator, the method further comprising the step of: (e1) actuating the hydraulic pin to engage the pin retaining receptacle of the motion compensator.

19. The method according to claim 17 further comprising the steps of:

h) suspending a well intervention tool from the hoisting means of the first winch;

i) removing the coiled tubing from the well and the coiled tubing injector head;

j) horizontally reciprocating the winch assembly or reciprocating plate to move the second winch out of operative alignment with the subsea wellhead and the first winch into alignment with the subsea wellhead;

k) operatively connecting the well intervention tool to the well;

l) performing additional well intervention work on the well using the well intervention tool.

20. The method according to claim 19 further comprising the steps of:

m) disconnecting the well intervention tool from the well;

n) removing the well intervention tool from the hoisting means of the first winch;

o) removing the motion compensator and coiled tubing injector head from the hoisting means of the second winch;

p) disassembling the apparatus.

* * * * *